US007311100B1

(12) United States Patent
Siewers

(10) Patent No.: US 7,311,100 B1
(45) Date of Patent: Dec. 25, 2007

(54) INJECTION AND ADJUSTING HANDLE FOR ABRASIVE CUTTING-OFF MACHINE

(76) Inventor: Knut Siewers, Brookgang 10, 21465 Wentorf (DE) 21465

( * ) Notice: Subject to any disclaimer, the term of this patent is extended or adjusted under 35 U.S.C. 154(b) by 0 days.

(21) Appl. No.: 11/592,762

(22) Filed: Nov. 3, 2006

(51) Int. Cl.
*B26D 7/08* (2006.01)

(52) U.S. Cl. ..... 125/13.01; 125/11.22; 125/14; 451/450

(58) Field of Classification Search ..... 451/450, 451/455, 358; 125/13.01, 11.22, 14
See application file for complete search history.

(56) References Cited

U.S. PATENT DOCUMENTS

| | | | | |
|---|---|---|---|---|
| 3,896,783 | A | 7/1975 | Manning | |
| 4,060,940 | A * | 12/1977 | DeWitt | 451/358 |
| 4,848,001 | A * | 7/1989 | Clark et al. | 30/391 |
| 5,129,416 | A * | 7/1992 | Ackroyd | 137/218 |
| 5,140,754 | A * | 8/1992 | Martenson | 30/390 |
| 5,826,478 | A * | 10/1998 | Zerrer | 83/169 |
| 6,442,841 | B1 * | 9/2002 | Nilsson et al. | 30/123.3 |
| 6,478,666 | B1 * | 11/2002 | Berger et al. | 451/344 |

FOREIGN PATENT DOCUMENTS

| | | |
|---|---|---|
| DE | 195 45 416 A | 6/1997 |
| DE | 10 2005 004 29 A1 | 5/2006 |
| GB | 2 307 874 A | 6/1997 |
| GB | 2 419 561 A | 5/2006 |

* cited by examiner

*Primary Examiner*—Joseph J. Hail, III
*Assistant Examiner*—Anthony Ojini
(74) *Attorney, Agent, or Firm*—Kelly Lowrey & Kelley LLP

(57) ABSTRACT

The invention relates to a tool, in particular an abrasive cutting-off machine (1), having a cutting tool (7) and a protective hood (8), partly covering the cutting tool (7) and [lacuna] in its relative position to the cutting tool (7), and an adjusting handle arranged on the outside of the protective hood (8), by which the position of the protective hood (8) can be adjusted by the user, and an injection device for water, which is arranged on the protective hood (8) and directed towards the cutting tool (7) and by which flying dust and chips arising during the cutting operation can be averted, the injection device and the adjusting handle being comprised by an injection and adjusting handle (6).

11 Claims, 3 Drawing Sheets

13
17
18
28
24
28
V
V
22
26
14
27

21
19
23

29
30
31
VI
VI
16

INJECTION AND ADJUSTING HANDLE FOR ABRASIVE CUTTING-OFF MACHINE

BACKGROUND OF THE INVENTION

The invention relates to a tool, in particular an abrasive cutting-off machine, having a cutting tool a protective hood, an adjusting handle and an injection device.

Tools in the form of abrasive cutting-off machines are sufficiently well-known. Abrasive cutting-off machines can be operated by a user in different ways. In manual operation, the abrasive cutting-off machine is gripped by the user by way of two handles. To cut short lines, the user then has to carry and guide the abrasive cutting-off machine by way of the handles. In particular for cutting long lines or expansion joints in floor coverings, manual operation requires too much effort and is thus unsuitable. The abrasive cutting-off machine can, however, be mounted on a guiding carriage for this purpose. The guiding carriage relieves the user of the need to carry the abrasive cutting-off machine. In cutting operation, i.e. carriage operation, but also in manual operation, flying dust and chips develop. The swirled-up dust is damaging to health if it gets into the user's lungs. To reduce the development of dust, it is known in principle, for example from DE 20 2004 000 416 U1, to spray water onto the cutting wheel. For this purpose, a water supply system with polyurethane hoses (PU hoses) and quick T and L screw connections is provided on the protective hood. In manual operation, the PU hose is connected to a pressure water tank. Pressures exceeding 5 bar may occur in the hose. In carriage operation, a water tank is arranged above the abrasive cutting-off machine and supplies the water supply system with falling water. In both operating modes of the abrasive cutting-off machine, assembly of the water supply system is time-consuming and costly in terms of material.

The protective hoods of abrasive cutting-off machines can be adjusted in their angular position by rotating them about the axis of rotation of the cutoff wheel. For this purpose, an adjusting handle is provided on the protective hood.

The object of the present invention is to provide a water supply system for an abrasive cutting-off machine which can be assembled more quickly.

The object is achieved in the case of a tool of the generic type, in particular an abrasive cutting-off machine, in that an injection and adjusting handle comprises the injection device and the adjusting handle.

SUMMARY OF THE INVENTION

According to the invention, injection device and adjusting handle are embodied in one component. As a result, the number of components, the assembly time and the production costs are reduced. The component according to the invention combines functions of two conventional components in a space-saving manner.

Preferably, the injection and adjusting handle is arranged in the radial direction on the outside of the protective hood, and it has a water conduit arranged transversely to the plane of the cutoff wheel. As a result of the water conduit which runs internally in the injection and adjusting handle, preferably in the handle region of the latter, a water-conveying connection between the two sides of the cutoff wheel is provided. It is thus possible to dispense with a separate water supply from the water tank to each of the two sides of the cutoff wheel or a hose connection from one side of the cutoff wheel to the other. The shorter and reduced number of hoses means that there is less risk of catching.

Favourably, the water conduit branches into at least a first duct and a second duct, each of which has at least one opening on respective sides of the cutoff wheel. The two ducts lead water to each of the two cutoff wheel sides, with the result that a particularly large amount of dust can be bound. The injection and adjusting handle has a hose connection for a hose coming from the water tank to the water conduit. From there, the supplied water branches into the at least two ducts. Compared with the water distribution through a hose system, the duct system according to the invention is more durable and easier to assemble.

In a preferred embodiment of the invention, the injection and adjusting handle can be fastened on the outside of the protective hood. The fastening, preferably by screws or clips, is sufficiently firm here for it to withstand forces produced by adjusting the protective hood by way of the handle portion of the injection and adjusting handle.

In a section plane arranged transversely to the plane of the cutoff wheel, the injection and adjusting handle according to the invention has a substantially U-shaped cross-section, and the handle portion forms the U-bottom of the injection and adjusting handle. In the assembled state, the U-shaped injection and adjusting handle is fitted by its open side onto a narrow side of the protective hood. In this case, the U-legs of the injection and adjusting handle come to bear against two side walls of the protective hood. Favourably, the two U-legs have fastening means, preferably in the form of holes for screws to be inserted.

The injection and adjusting handle can be constructed from individual components by simple screw or plug connections. Preferably, the injection and adjusting handle has a substantially T-shaped middle piece and a substantially L-shaped end piece, which are provided to form together the substantially U-shaped injection and adjusting handle. Middle piece and end piece can be fitted together by a plug connection sealed off via a rubber ring. The first water duct is preferably provided in the T-leg and the second water duct is preferably provided in the L-leg. Both water ducts open into a respective opening aimed towards the cutoff wheel and preferably designed as a nozzle.

Preferably, the injection and adjusting handle has a metering device for the quantity of water sprayed onto the cutoff wheel per unit of time. The quantity of water consumed can thus be adapted to the circumstances. The metering device has a first chamber and a second chamber which are separated from one another by a partition wall having a through-passage. The through-passage is intended for introducing a conical spigot with adjustable penetration depth. With increasing penetration depth, the through-passage has a decreasing cross-section.

The penetration depth is preferably adjustable via two threads which can be screwed into one another. An external thread can be provided on an adjusting piece next to the conical spigot, and a corresponding internal thread can be formed next to the second chamber on the T-shaped middle piece.

Water can be supplied to the injection and adjusting handle preferably via a hose connection piece. The hose connection piece can be imbricated and be integrally moulded onto one end of the T-leg of the middle piece, preferably in the longitudinal direction of the T-leg. A water supply duct can run in the T-leg in its longitudinal direction from the hose connection piece to the second chamber and thus to the metering device. This embodiment of the injection and adjusting handle according to the invention has a small structural width.

The L-shaped end piece, the substantially T-shaped middle piece, and the hose connection pieces can consist of plastic and be injection moulded.

BRIEF DESCRIPTION OF THE DRAWINGS

The invention is described by way of example with the aid of an exemplary embodiment in seven figures, in which.

DETAILED DESCRIPTION OF THE PREFERRED EMBODIMENTS

Figure 1:
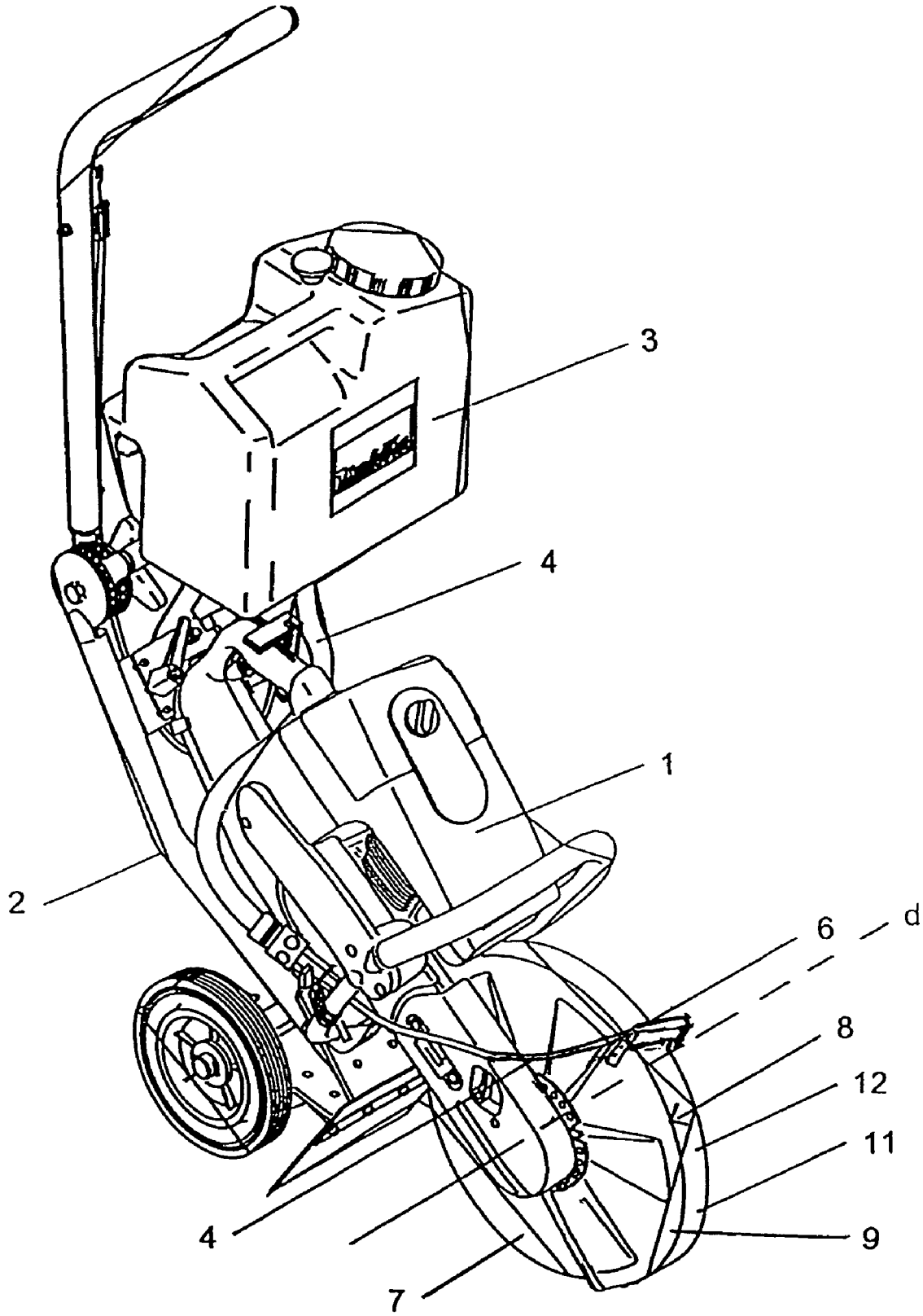
FIG. 1 shows a perspective view of an abrasive cutting-off machine according to the invention, mounted on a guiding carriage.

The abrasive cutting-off machine 1 illustrated in FIG. 1 is mounted with an associated water supply on an abrasive cutting-off machine carriage 2. The water supply has a water tank 3 arranged on the abrasive cutting-off machine carriage 2 in the region above the abrasive cutting-off machine 1. Leading off from the bottom of the water tank 3 is one end of a multi-piece, falling water-conveying polyurethane hose (PU hose) 4, the other end of which is connected to an injection and adjusting handle 6 according to the invention.

The abrasive cutting-off machine 1 has, at its end facing the ground in the assembled state, a cutoff wheel 7, of which the sector remote from the ground is covered by a protective hood 8 adjustable about an axis of rotation d of the cutoff wheel 7. The protective hood 8, which can be locked into place in different angular positions about the axis of rotation d, has two mutually opposite semicircular side walls 9, 11, the circular borders of which are connected to one another via a semi-annular narrow side 12 and between which the sector of the cutoff wheel 7 is accommodated.

The injection and adjusting handle 6 is of substantially U-shaped design in a cross-section perpendicular to the plane of the cutoff wheel 7. The U-bottom of the injection and adjusting handle 6 touches the narrow side 12, and the two U-legs are each led along one of the side walls 9, 11 and firmly screwed to them. After releasing the protective hood locking device, the user can grip the injection and adjusting handle 6 and rotate the protective hood 8 thereon about the axis of rotation d, and then re-lock it in the desired angular position.

The construction of the injection and adjusting handle 6 according to the invention is illustrated in FIG. 2 to FIG. 7. In the description, its function as an injection nozzle in particular is explained.

Figures 2, 3, 4:
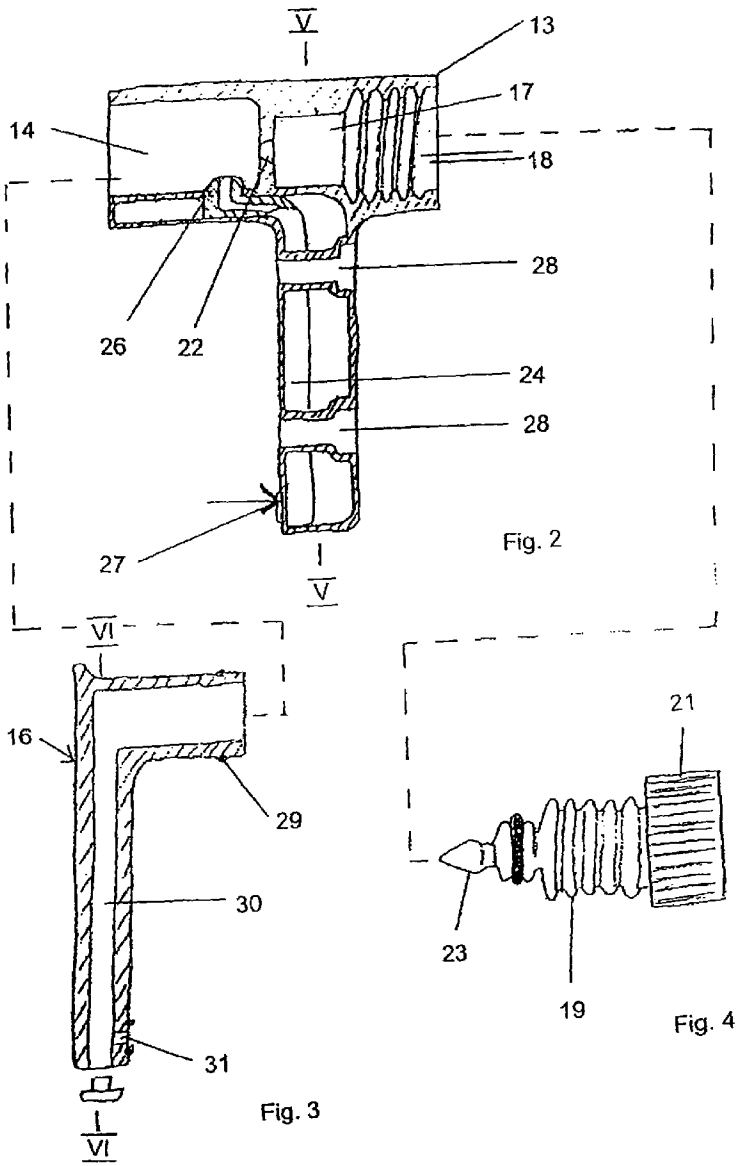
FIG. 2 shows a sectional view perpendicular to plane of cutoff wheel of a middle piece of an injection and adjusting handle according to the invention.
FIG. 3 shows a sectional view perpendicular to plane of cutoff wheel of an end piece of the injection and adjusting handle.
FIG. 4 shows an adjusting piece.

The injection and adjusting handle 6 has, according to FIG. 2, a middle piece 13 of substantially T-shaped design in a cross-section perpendicular to the plane of the cutoff wheel 7. Provided in the first T-arm, facing the protective hood 8, of the middle piece 13 is a first chamber 14, into which an L-foot of an L-shaped end piece 16, according to FIG. 3, can be water-tightly plugged. Provided between the first T-arm and a second T-arm is a second chamber 17, and provided in the second T-arm is an internal thread 18 adjoining the second chamber 17. The internal thread 18 cooperates with an external thread 19 of an adjusting piece 21, according to FIG. 4. The two chambers 14, 17 are separated from one another by a partition wall having a through-passage 22 which tapers conically in a cross-section in the direction from the second chamber 17 towards the first chamber 14. A spigot 23 tapering conically towards the point can be introduced with adjustable depth into the through-passage 22. The through-passage 22 and the spigot 23 cooperate as a metering tap for the quantity of water sprayed onto the cutoff wheel 7 per unit of time. With greater penetration depth the through-flow cross-section of the through-passage 22 is reduced and the through-passage 22 is, where appropriate, completely closed, and with lesser penetration depth the through-flow cross-section is increased. The penetration depth is adjustable by screwing the external thread 19 and the internal thread 18 in or out.

The first chamber 14 has a duct inlet 26, arranged next to the through-passage 22, for a first water duct 24 led through the T-leg of the middle piece 13. Provided at the end of the first water duct 24 opposite the duct inlet 26 is a nozzle 27 which, in the assembled state, is led through the side wall 9 of the protective hood 7 and aimed at the cutoff wheel 7 (not depicted).

Next to the first water conduit 24, two holes 28 are provided through the T-leg, through which holes can be led in each case one screw which can be screwed into an internal thread provided at a corresponding location in the side wall 9.

The end piece 16, according to FIG. 3, is of substantially L-shaped design in the cross-section perpendicular to the plane of the cutoff wheel 7. In the assembled state, the L-foot can be plugged into the first chamber 14 of the middle piece 13 in a manner sealed off via an O-ring 29 let into its outer wall. The end piece 16 is of substantially hollow design and has a second water duct 30 which leads water from the L-foot to the outer end of the L-leg. The L-leg can be closed off by a plug at its end facing away from the L-foot. The L-leg also has at the end a nozzle 31 which is aimed at the cutoff wheel 7 and, in the assembled state, is led through the side wall 11. The two nozzles 27, 31 lie mutually opposite at a clear distance on the injection and adjusting handle 6 and in operation spray the cutoff wheel 7 with water on each of its wheel sides.

The adjusting piece 21 has, at the end opposite the spigot 23, a profiled rotary knob.

Figure 5:
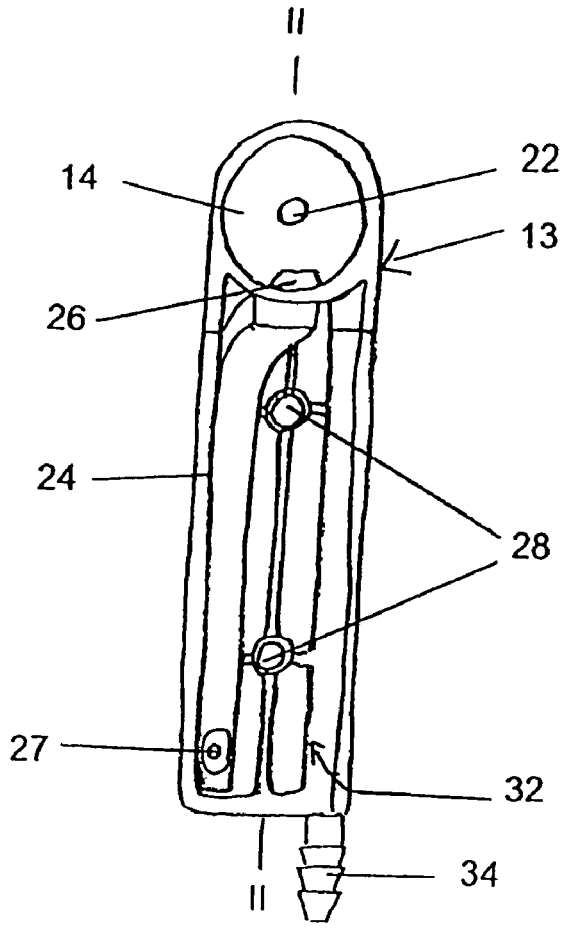
FIG. 5 shows a sectional view parallel to plane of cutoff wheel of a middle piece of the injection and adjusting handle.

The plan view shown in FIG. 5—partly as a section along the line V-V in FIG. 2—of the middle piece 13 shows the relative arrangement between the first chamber 14, the duct inlet 26, the first water duct 24 and the through-passage 22. The first water duct 24 is formed as a moulded component of elastic material, preferably rubber, and the duct inlet 26 and the nozzle 27 have integrally formed engaging-behind portions which are plugged into corresponding openings of the middle piece 13. The first water duct 24 is led in the longitudinal direction of the T-leg and in this regard next to the holes 28. The two holes 28 are arranged one above the other in the longitudinal direction of the T-leg.

The middle piece 13 has a water supply duct 32. The water supply duct 32 is preferably led along the wall of the middle piece 13, which wall consists of plastic. An outer end of the water supply duct 32 is formed by an imbricated hose connection piece 34. The hose connection piece 34 projects from the middle piece 13 in the longitudinal direction of the T-leg. The PU hose 4 coming from the water tank 3 can be plugged onto it. Another end of the water supply duct 32 ends in the second chamber 17.

Figure 6:
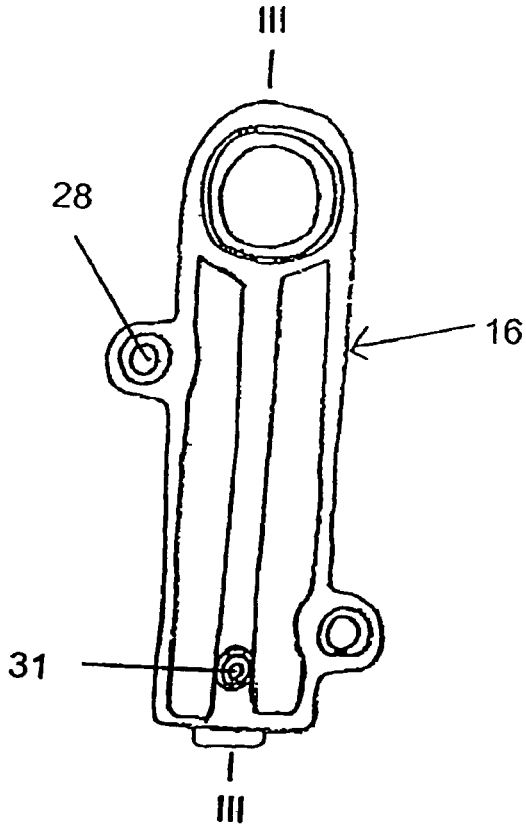
FIG. 6 shows a sectional view parallel to plane of cutoff wheel of an end piece of the injection and adjusting handle.

FIG. 6 shows a front view, partly as a section, of the end piece 16 along the line VI-VI in FIG. 3. The second water duct 30 runs along the entire length of the L-leg, but occupies only part of its width. A nozzle 31 is provided at the outer end of the second water duct 30. Two holes 28 for screws for fastening the end piece 16 in internal threads provided therefor and let into the side wall 11 are integrally connected in a laterally offset manner to the L-leg.

The invention claimed is:

1. An abrasive cutting-off machine comprising a cutting tool (7);

a protective hood (8), partly covering the cutting tool (7) and adjustable in its relative position to the cutting tool (7);

an adjusting handle arranged on the outside of the protective hood (8) by which the position of the protective hood (8) can be adjusted by the user;

an injection device for water, which is arranged on the protective hood (8) and directed towards the cutting tool (7) and by which flying dust and chips arising during the cutting operation can be bound; and a combined injection and adjusting handle (6) comprising the injection device and the adjusting handle, the injection and adjusting handle (6) having a substantially U-shaped cross-section in a section plane arranged transversely to the plane of the cutting tool (7), wherein a bottom of the U-shape comprises the adjusting handle and the bottom of the U-shape is positioned adjacent to a narrow side of the protective hood (8) and two legs of the U-shape are positioned adjacent to side walls (9, 11) of the protective hood (8), wherein the injection and adjusting handle (6) comprises a water conduit (14, 17) running through the bottom of the U-shape transverse to the plane of the cutting tool (7), the water conduit (14, 17) branching into a first water duct (24) and a second water duct (30) which are provided in the legs of the U-shape, and a first nozzle (27) and a second nozzle (31) at ends of each of the ducts (24, 30) directed to opposite sides of the cutting tool (7) on the interior of the protective hood (8).

2. The machine according to claim 1, wherein the injection and adjusting handle (6) is fastened on the outside of the protective hood (8).

3. The machine according to claim 2, wherein the legs of the U-shape have holes (28) for screws, by which the injection and adjusting handle (6) can be firmly screwed to the protective hood (8).

4. The machine according to claim 1, wherein the injection and adjusting handle (6) has a substantially T-shaped middle piece (13) and a substantially L-shaped end piece (16), which are connected to one another water-tightly via a plug connection to form the U-shape.

5. The machine according to claim 4, wherein the middle piece (13) comprises the first water duct (24) leading through a leg of the T-shaped piece to an outer end, and the first water duct (24) opens there into the first nozzle (27) aimed towards the cutting tool (7).

6. The machine according to claim 4, wherein the end piece (16) comprises the second water duct (30) leading through it's a leg of the L-shaped piece to an outer end, and the second water duct (30) opens there into the second nozzle (31) aimed towards the cutting tool (7).

7. The machine according to claim 4, wherein a hose connection piece (34) leads off from the substantially T-shaped middle piece (13), as a continuation of the T-leg.

8. The machine according to claim 7, wherein a water supply duct (32) connecting the hose connection piece (34) to the second chamber (17) is provided in the leg of the T-shaped middle piece (13).

9. The machine according to claim 1, further comprising an adjustable metering device in the water conduit for controlling the quantity of water sprayed onto the cutting tool (7) per unit of time.

10. The machine according to claim 9, wherein the metering device has a partition wall separating the water conduit (14, 17) into a first chamber (14) and a second chamber (17) and having a through-passage (22), into which a conical spigot (23) can be introduced with adjustable penetration depth.

11. The machine according to claim 10, wherein an internal thread (18) is provided adjacent the second chamber (17) for engaging an external thread (19) of an adjusting piece (21), and the spigot (23) is provided on the adjusting piece (21), wherein the penetration depth is adjustable by screwing the two threads (18, 19) into one another.

* * * * *